US012523024B2

(12) United States Patent
Wang et al.

(10) Patent No.: US 12,523,024 B2
(45) Date of Patent: Jan. 13, 2026

(54) SENSING AND TOUCH-CONTROLLED FAUCET

(71) Applicant: XIAMEN DELMEI SANITARY WARE CO., LTD., Xiamen (CN)

(72) Inventors: Chunhua Wang, Xiamen (CN); Yongqiang Yan, Fuzhou (CN)

(73) Assignee: XIAMEN DELMEI SANITARY WARE CO., LTD., Xiamen (CN)

( * ) Notice: Subject to any disclaimer, the term of this patent is extended or adjusted under 35 U.S.C. 154(b) by 202 days.

(21) Appl. No.: 18/448,141

(22) Filed: Aug. 10, 2023

(65) Prior Publication Data

US 2025/0019945 A1 Jan. 16, 2025

(30) Foreign Application Priority Data

Jul. 14, 2023 (CN) ..... 202321863942.3

(51) Int. Cl.
*E03C 1/05* (2006.01)
*A47K 5/12* (2006.01)
*E03C 1/046* (2006.01)

(52) U.S. Cl.
CPC ..... *E03C 1/055* (2013.01); *A47K 5/1217* (2013.01); *E03C 1/046* (2013.01)

(58) Field of Classification Search
CPC ..... E03C 1/055; E03C 1/046; E03C 1/0404; E03C 1/057; A47K 5/1217; A47K 2005/1218
USPC ..... 4/623, 619, 302, 313, 668; 137/562; 239/16, 569; 251/31; 331/6; 340/591, 340/573.1; 361/173, 179
See application file for complete search history.

(56) References Cited

U.S. PATENT DOCUMENTS

| | | | | |
|---|---|---|---|---|
| 4,722,372 | A * | 2/1988 | Hoffman | A47K 5/1214 250/221 |
| 9,995,025 | B2 * | 6/2018 | Wang | A47K 5/1217 |
| 10,349,787 | B2 * | 7/2019 | Burgo, Sr. | A47K 5/1202 |
| 10,428,498 | B1 * | 10/2019 | Montague | E03C 1/057 |
| 12,338,611 | B2 * | 6/2025 | Gibson | E03C 1/057 |
| 12,339,417 | B2 * | 6/2025 | Maddanimath Veerayya | G01V 8/10 |
| 2004/0211000 | A1 * | 10/2004 | Buonocore | E03C 1/0404 4/675 |
| 2005/0087557 | A1 * | 4/2005 | Oliver | A47K 5/1217 222/251 |

(Continued)

FOREIGN PATENT DOCUMENTS

| | | | | |
|---|---|---|---|---|
| DE | 102023108557 | A1 * | 10/2024 | E03C 1/057 |
| KR | 102637905 | B1 * | 2/2024 | E03C 1/046 |

(Continued)

*Primary Examiner* — Lori L Baker

(57) ABSTRACT

A sensing and touch-controlled faucet includes a casing, a covering plate, a water flow sensor, and a soap sensor. The casing has a water outlet arranged proximal to the bottom of a faucet working end, the casing also has a soap dispensing port and a mounting cavity communicating with the water outlet and the soap dispensing port, the soap dispensing port is arranged near the water outlet and the soap dispensing port is located at a side away from a faucet working end relative to the water outlet. When washing hands with the faucet, after the soap falls on the inner side of the fingers, if the motion of the hands is rapidly detected by the water flow sensor which then controls the water outlet to discharge water, the soap will not be easily washed away by the water flow.

9 Claims, 7 Drawing Sheets

(56) References Cited

U.S. PATENT DOCUMENTS

2006/0101575 A1* 5/2006 Louis ..... E03C 1/046 4/676
2011/0027148 A1* 2/2011 Zlatic ..... E03C 1/046 222/630
2015/0101121 A1* 4/2015 Burgo, Sr. ..... A47K 5/12 4/668
2020/0281417 A1* 9/2020 Meyer ..... A47K 5/1217
2022/0081885 A1* 3/2022 Leighton ..... E03C 1/057
2022/0151441 A1* 5/2022 Bai ..... B05B 7/0062
2022/0290418 A1* 9/2022 Dombrowsky ..... E03C 1/182
2022/0298764 A1* 9/2022 Burgo, Sr. ..... E03C 1/046
2023/0023704 A1* 1/2023 Bai ..... A47K 5/14
2023/0173121 A1* 6/2023 Beckman ..... A61L 2/22 422/28
2023/0203797 A1* 6/2023 McLennan ..... E03C 1/0404 4/675
2023/0350095 A1* 11/2023 Maddanimath Veerayya ..... G01J 1/4228
2023/0414045 A1* 12/2023 Doubet ..... A47K 5/1217
2024/0084567 A1* 3/2024 Ren ..... A47K 5/1217
2024/0151014 A1* 5/2024 Koyala ..... E03C 1/055
2024/0209604 A1* 6/2024 Gibson ..... E03C 1/055
2024/0218640 A1* 7/2024 Frye ..... E03C 1/055
2024/0288093 A1* 8/2024 Bush ..... F16K 31/0675
2024/0353902 A1* 10/2024 Baumgarte ..... A47K 3/281
2025/0019947 A1* 1/2025 Thomas ..... E03C 1/0404

FOREIGN PATENT DOCUMENTS

KR 102728288 B1 * 11/2024 ..... F26B 21/004
TW 202423353 A * 6/2024 ..... A47K 5/1217
WO WO-2022162661 A1 * 8/2022 ..... G08B 21/245
WO WO-2024054679 A1 * 3/2024 ..... A47K 5/1217
WO WO-2024137932 A1 * 6/2024 ..... E03C 1/055

* cited by examiner

SENSING AND TOUCH-CONTROLLED FAUCET

CROSS-REFERENCE TO RELATED APPLICATIONS

This application is based upon and claims priority to Chinese Patent Application No. 202321863942.3, filed on Jul. 14, 2023, the entire contents of which are incorporated herein by reference.

TECHNICAL FIELD

The present disclosure relates to a sensing and touch-controlled faucet.

BACKGROUND

The sensing faucet is an intelligent faucet device which can sense the approach of a human body or an object without direct contact through technologies such as an infrared sensor and can automatically open or close a water source.

The steps of using the sensing faucet in the related art to wash hands include: first press a soap dispenser to yield soap on the palm of one hand, and moving the other hand so that the sensor can detect the motion of the hand to discharge water from the water outlet of the faucet and wet the palms, then clean and wash the two hands.

However, in the above steps, what may happen to an user is that after the soap is dispensed on the palm of one hand, the sensor rapidly detects the motion of the user's hand, and the water outlet immediately discharges water, as a result, the soap on the palm is directly washed away, thereby causing waste of the soap and poor user experience.

Therefore, a sensing and touch-controlled faucet is designed in the present disclosure in view of one or more of the above problems.

SUMMARY

In order to solve the above problems, the present disclosure provides a sensing and touch-controlled faucet.

To achieve the above objective, the present disclosure proposes the following technical solutions.

A sensing and touch-controlled faucet includes a casing, wherein the casing includes a water outlet arranged proximal to the bottom of a faucet working end, the casing further includes a soap dispensing port and a mounting cavity communicating with the water outlet and the soap dispensing port, the soap dispensing port is arranged near the water outlet and the soap dispensing port is located at a side away from the faucet working end relative to a water outlet;

- a covering plate, wherein the covering plate covers the casing for closing the mounting cavity;
- a water flow sensor, wherein the water flow sensor is arranged on a side wall surface of the casing for controlling a water discharge of the water outlet;
- a soap sensor, wherein the soap sensor is couple to the covering plate at an end proximal to the faucet working end for controlling a soap discharge of the soap dispensing port;
- wherein, when a user's palm facing upward is placed below the water outlet, an inner side of the user's fingers is directly opposite to the soap dispensing port.

The present disclosure has the following advantages: when washing hands with the presently disclosed faucet, after the soap falls on the inner side of fingers, if the motion of hands is rapidly detected by the water flow sensor which then controls the water outlet to discharge water, since the soap dispensing port is located at a side of the casing away from the water outlet, the discharged water will not rapidly wash the soap away, thereby effectively avoiding waste of the soap and achieving better user experience.

BRIEF DESCRIPTION OF THE DRAWINGS

In order to clearly explain the technical solutions of implementations of the present disclosure, the drawings that would be used in describing the implementations will briefly be introduced below. It should be understood that the drawings illustrated below merely include some of the embodiments of the present disclosure and should not be considered as limiting the scope of the present disclosure. For those of ordinary skill in the art, other related drawings may be derived based on these drawings without creative effort.

REFERENCE NUMERALS IN THE DRAWINGS

Figure 1:
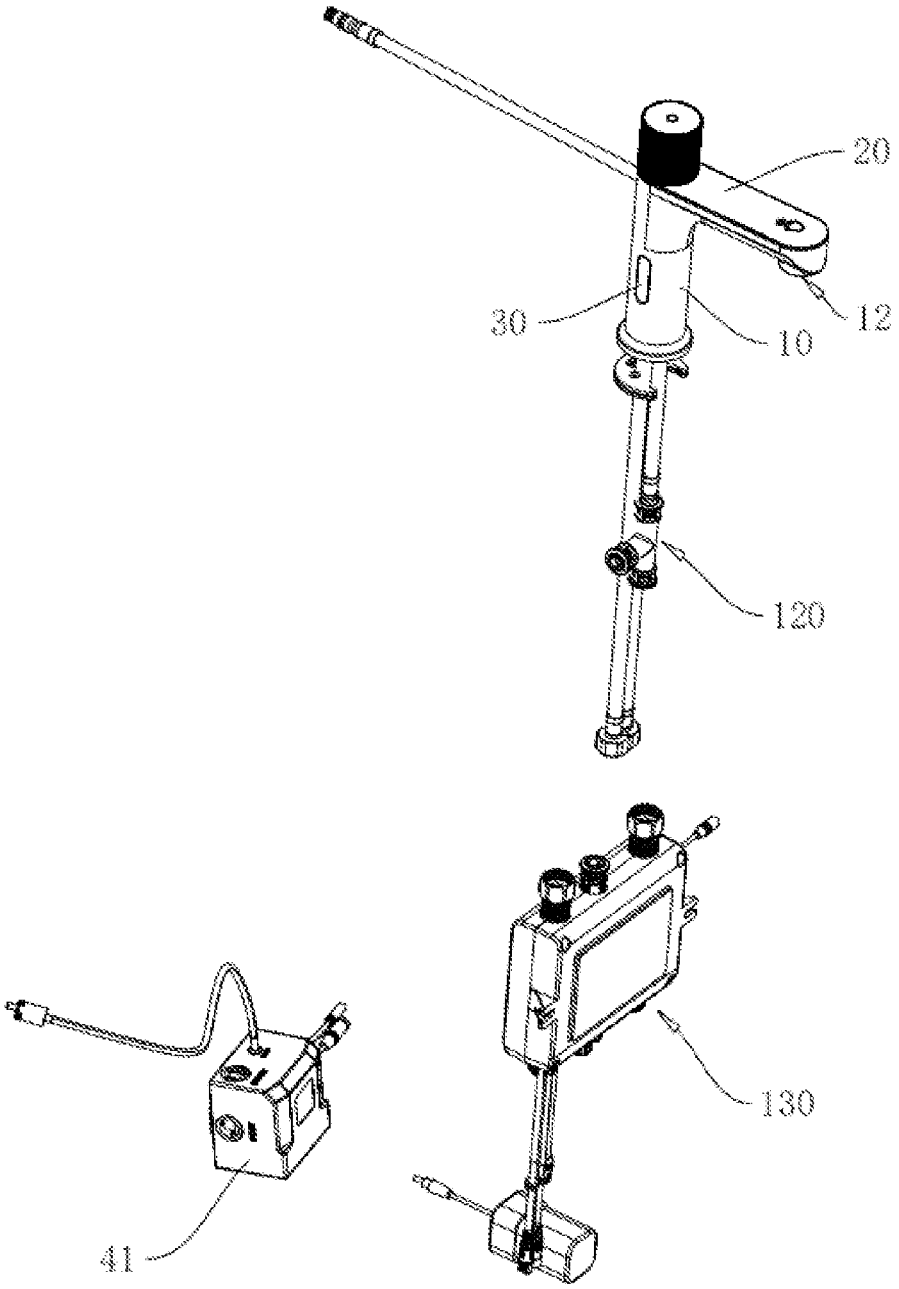
FIG. 1 is an overall structural schematic diagram of one embodiment of the present disclosure.

10—casing; 11—mounting cavity; 12—water outlet; 13—soap dispensing port;
14—positioning groove; 15—mounting column;
20—covering plate;
30—water flow sensor;
40—soap sensor; 41—soap dispensing controller
50—supporting plate; 51—mounting hole; 52—through hole; 53—hook portion;
54—stabilizing block; 55—reinforcing rib;
60—fastener; 61—bolt; 62—engagement structure; 621—engagement ball; 622—partition;
70—3M adhesive tape; 71—avoidance hole;
80—aerator;
90—soap conveying pipe; 91—soap inlet; 92—soap outlet;
100—connector; 101—aerator mounting cover; 102—connecting rib; 103—reinforcing rib;
110—temperature display screen;
120—water inlet assembly;
130—thermostatic temperature controller.

DETAILED DESCRIPTION OF THE EMBODIMENTS

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure.

In the description of the present disclosure, the terms "first", "second" are used only for descriptive purposes and cannot be understood as indicating or implying relative importance or implying the number of indicated technical features. Thus, a characteristic that is referred to by "first" and "second" may include, expressly or implicitly, one or more of the characteristics. In the description of the present disclosure, "multiple/several" means two or more, unless otherwise expressly and specifically defined.

Figure 2:
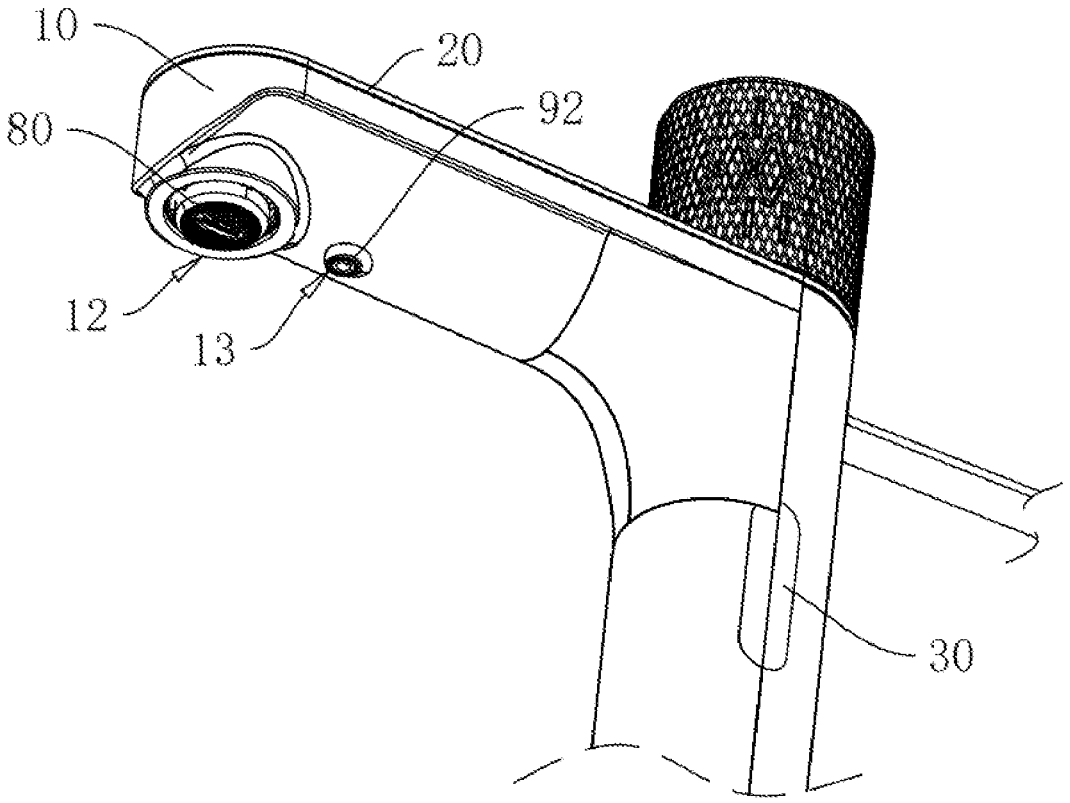
FIG. 2 is a structural schematic diagram of one embodiment of the present disclosure, wherein a water outlet and a soap dispensing port are shown.
Figure 3:
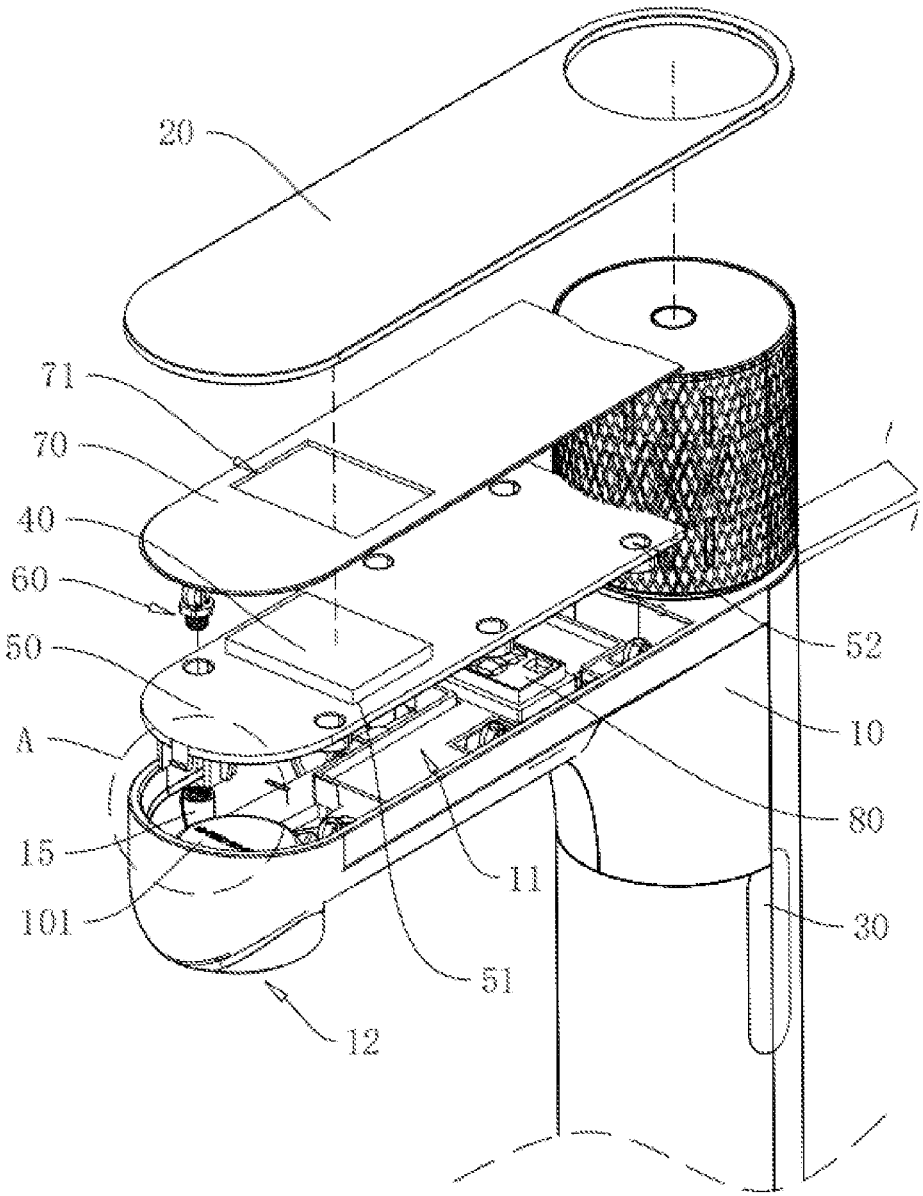
FIG. 3 is an exploded view of one embodiment of the present disclosure, wherein a soap sensor is shown.

As shown in FIGS. 1-3, a sensing and touch-controlled faucet includes a casing 10 and a covering plate 20 which covers the casing 10. The casing 10 includes a water outlet 12, a soap dispensing port 13, and a mounting cavity 11 communicating with the water outlet 12 and the soap dispensing port 13. The faucet further includes a water flow sensor 30 for controlling the water discharge of the water outlet 12 and a soap sensor 40 for controlling the discharge of soap of the soap dispensing port 13. The soap sensor 40 is mounted at the bottom of the covering plate 20 at a side proximal to the water outlet 12, and the water flow sensor 30 is mounted on a side wall surface of the casing 10.

As shown in FIG. 1, a lower end of the casing 10 is mounted with a water inlet assembly 120 and a thermostatic temperature controller 130 is externally connected to a lower end of the water inlet assembly 120. The thermostatic temperature controller 130 is electrically connected to the water flow sensor 30 to control the water discharge of the water outlet of the casing 10.

As shown in FIG. 3, in the present embodiment, the soap sensor 40 is a pressure sensor. In the application environments of faucets, the user's hands may be wet and left with some sort of liquid, and the use of the capacitive sensor commonly seen in the related art may cause sensing failure. However, the use of pressure sensor can well solve the above problem and thus improving sensitivity of soap dispensing.

As shown in FIG. 2, the water outlet 12 is arranged at the bottom of the faucet working end, the soap dispensing port 13 is arranged close to the water outlet 12, and the soap dispensing port 13 is located at a side away from the faucet working end relative to the water outlet 12. When the user's palm facing upward is placed right under the water outlet 12, the inner side of the fingers is located right under the soap dispensing port 13.

Furthermore, as shown in FIGS. 1-2, the water flow sensor 30 may be mounted on the left side or the right side of the casing 10, the mounting position of the water flow sensor 30 is adjustable according to the user's washing habits. Alternatively, two sides of the casing 10 may all be provided with a water flow sensor 30 respectively, so as to improve the practicability of the faucet.

When washing hands, a user first puts one of his/her palms facing upward right under the water outlet 12, at this time the inner side of the fingers is located right under the soap dispensing port 13, then the user presses a top position of the covering plate 20 proximal to the water outlet 12 by another hand, the soap sensor 40 detecting pressure will control the soap dispensing port 13 to dispense soap and the discharged soap will fall on the inner side of the fingers, afterwards, the user waves his/her hand towards the side mounted with the water flow sensor 30, the water flow sensor 30 detecting the motion of the user's hand will control the water outlet 12 to discharge water, so as to allow the user to wash his/her hands.

When washing hands with the presently disclosed faucet, after the soap falls on the inner side of the fingers, if the motion of the hands is rapidly detected by the water flow sensor 30 which then controls the water outlet 12 to discharge water, since the soap dispensing port 13 is located at a side away from the faucet working end relative to the water outlet 12, the faucet working end is the end of the faucet where water flows out, the soap will not be easily washed away by the water flow. Therefore, waste of the soap can be effectively avoided. Further, since the discharged soap falls on the inner side of the fingers, the user only needs to bend his/her fingers to contact with the center of the palm to spread the soap all over the hand. Therefore, the steps for washing hands are simplified and better user experience can be achieved.

As shown in FIG. 3, the mounting cavity 11 of the casing 10 is internally engaged with a supporting plate 50. A mounting hole 51 for mounting the soap sensor 40 is provided on the supporting plate 50 at a position right opposite to the soap dispensing port 13. When the covering plate 20 covers the upper end of the casing 10, the soap sensor 40 located inside the mounting hole 51 contacts the lower end of the covering plate 20.

As shown in FIGS. 3-6, the faucet further includes a plurality of fasteners 60. The supporting plate 50 is mounted inside the mounting cavity 11 of the casing 10 through the plurality of fasteners 60. When the supporting plate 50 is assembled into the mounting cavity 11, an upper surface of an end of the supporting plate 50 away from the bottom wall of the mounting cavity 11 is flat and smooth. Specifically, the fasteners 60 each include a bolt 61 and an engagement structure 62 located at a top end of a nut portion of the bolt 61. The bottom wall of the mounting cavity 11 of the casing 10 protrudes upward to form a plurality of mounting columns 15 having threaded holes, and the supporting plate 50 has a plurality of through holes 52 for the bolts 61 to pass through. When the supporting plate 50 is engaged into the mounting cavity 11, the threaded holes on the mounting columns 15 are aligned with the position of the through holes 52.

Figure 4:
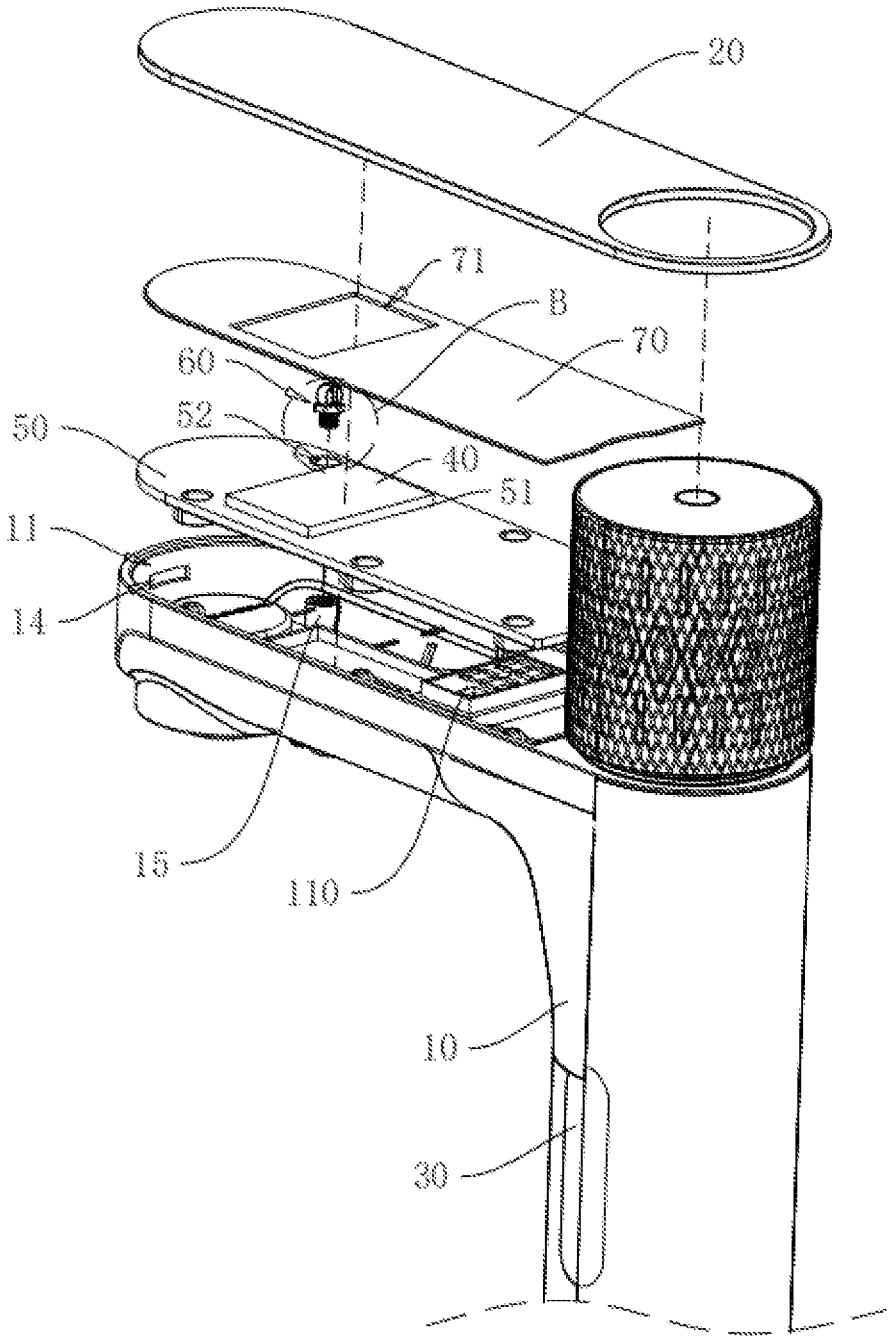
FIG. 4 is an exploded view of one embodiment of the present disclosure, wherein a positioning groove on a casing is shown.
Figure 5:
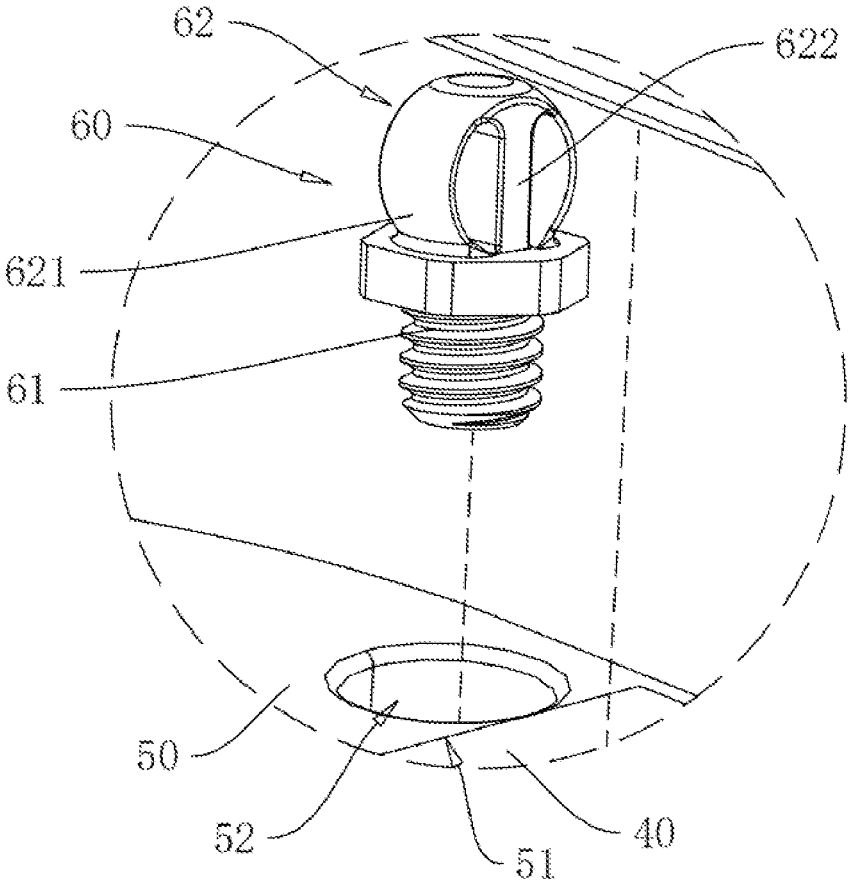
FIG. 5 is an enlarged view of portion B in the embodiment shown in FIG. 4.

As shown in FIG. 4 and FIG. 5, the engagement structure 62 includes an engagement ball 621 which is internally provided with a hollow cavity. The diameter of the engagement ball 621 is greater than that of the through hole 52. The supporting plate 50 is assembled into the mounting cavity 11 by interference fit and engagement of the engagement ball 621 and the through hole 52, and at this time the supporting plate 50 is located between the bottom wall of the mounting cavity 11 of the casing 10 and the covering plate 20.

As shown in FIG. 5, the engagement structure 62 further includes a partition 622 arranged on an inner wall of two opposite sides of the hollow cavity. The length direction of the partition 622 and the central axis of the bolt 61 are parallel to each other. The partition 622 splits the hollow cavity half and half to form two smaller deformation cavities which can not only allow the sidewall of the through hole 52 to uniformly squeeze the outer wall of the engagement ball 621, but also can improve the structural strength of the engagement ball 621. It should be noted that, the engagement ball 621 and the partition 622 are both elastic metal products with deformability.

Figure 6:
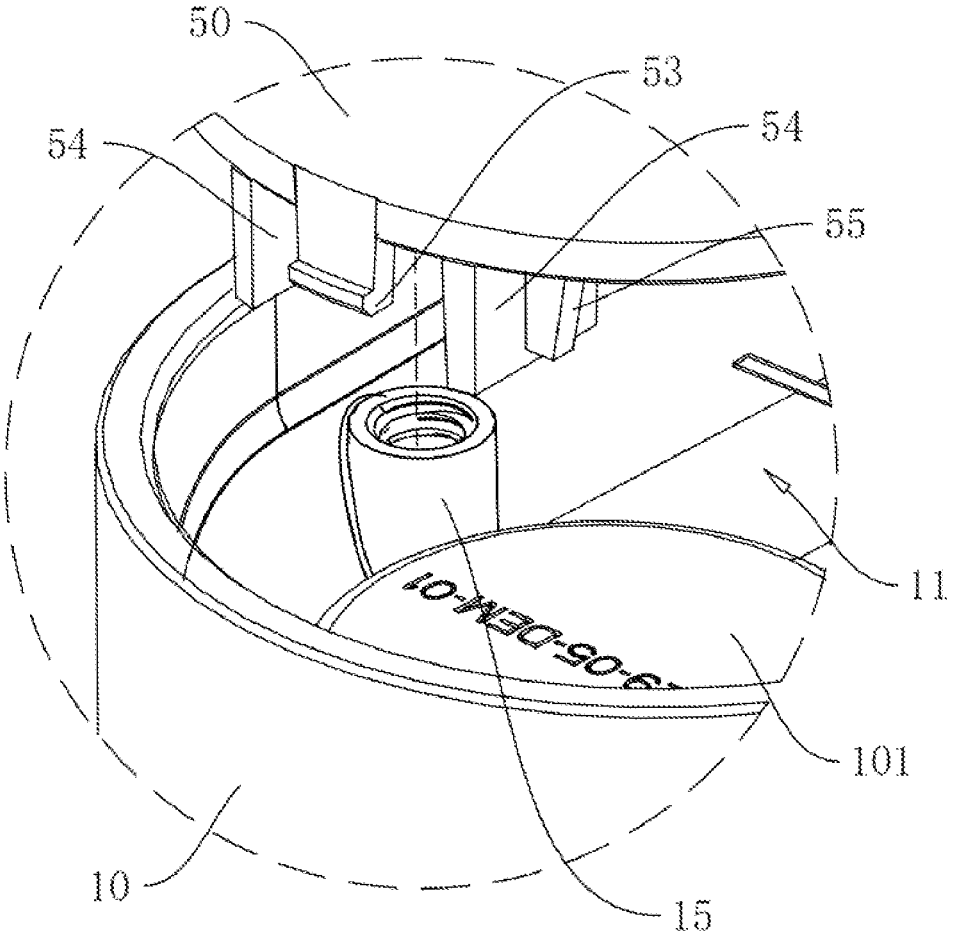
FIG. 6 is an enlarged view of portion Ain the embodiment shown in FIG. 3.

As shown in FIG. 4 and FIG. 6, a bottom wall of the supporting plate 50 is provided with a hook portion 53 on a side proximal to the faucet working end. The cavity wall of the mounting cavity 11 facing the faucet working end is provided with a positioning groove 14 for fitting and locking with the hook portion 53. When the hook portion 53 is locked in the positioning groove 14, the supporting plate 50 is positioned in the predetermined mounting position, so as to prevent the supporting plate 50 to move up and down relative to the casing 10, thereby improving stability of the mounted supporting plate 50.

As shown in FIG. 4, the mounting cavity 11 is internally provided with a temperature display screen 110, the covering plate 20 and the supporting plate 50 are both transparent plastic products. A 3M adhesive tape 70 is provided between the supporting plate 50 and the covering plate 20, and the 3M adhesive tape 70 is provided with an avoidance hole 71 at a position right opposite to the soap dispensing port 13. The avoidance hole 71 and the mounting hole 51 have the same size. The covering plate 20 is fixedly connected to the upper surface of the supporting plate 50 by the 3M adhesive tape 70, and the soap sensor 40 passes through the avoidance hole 71 to contact with the lower end of the covering plate 20.

Figure 7:
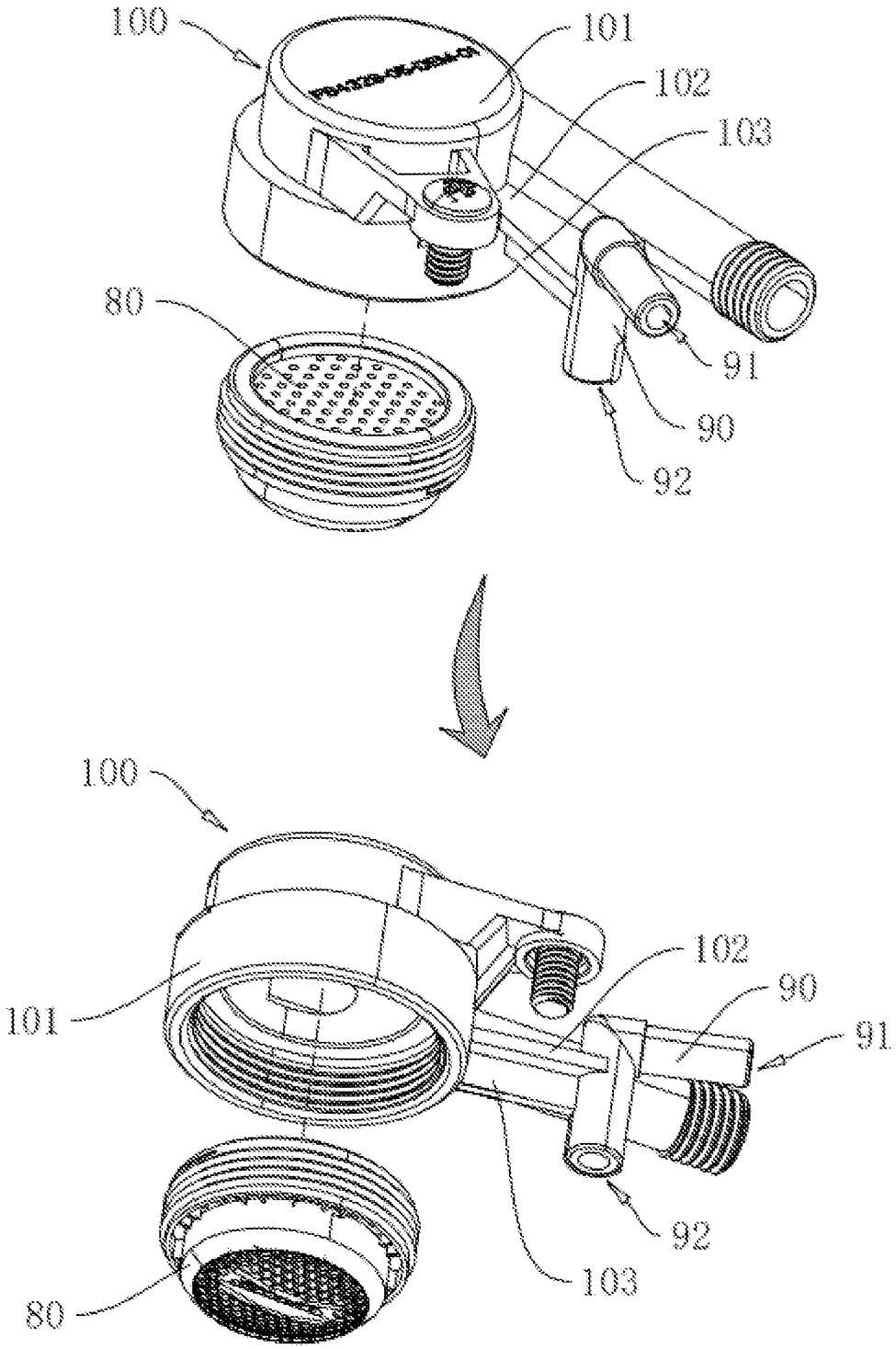
FIG. 7 is an enlarged view of one embodiment of the present disclosure, wherein the assembling relationship between an aerator and a soap conveying pipe is shown.

As shown in FIG. 1 and FIG. 7, the faucet further includes an aerator 80, an soap conveying pipe 90, and a connector 100 for connecting the aerator 80 and the soap conveying pipe 90. The connector 100 includes an aerator mounting cover 101 and a connecting rib 102 fixedly connected to the outer perimeter of the aerator mounting cover 101. The circumference of the aerator 80 is provided with outer threads for connecting with the lower end of the aerator mounting cover 101 by thread connection. The soap conveying pipe 90 is made hard plastic water pipe, and the soap conveying pipe 90 includes a soap inlet 91 and a soap outlet 92. The soap inlet 91 is externally connected to a soap dispensing controller 41 by a flexible pipe (not shown) to supply soap to the soap conveying pipe 90, and the soap dispensing controller 41 is electrically connected to the soap sensor 40.

As shown in FIG. 7, the length direction of the connecting rib 102 is perpendicular to the axial direction of the aerator mounting cover 101. An end of the connecting rib 102 away from the mounting cover is fixedly connected to an outer surface of the soap conveying pipe 90. The connector 100 further includes a reinforcing rib 103 provided on the connecting rib 102. An end of the reinforcing rib 103 is fixedly connected to the aerator mounting cover 101, another end of the reinforcing rib 103 is fixedly connected to the soap conveying pipe 90.

When assembling the aerator 80 and the soap conveying pipe 90, the aerator 80 is aligned with the water outlet 12 and is placed into the mounting cavity 11, as the aerator 80 is positioned in the water outlet 12, the soap outlet 92 of the soap conveying pipe 90 is aligned with the soap dispensing port 13, finally the connector 100 is screwed and fastened to the bottom wall of the mounting cavity 11 by screws.

As shown in FIG. 6, the bottom of the supporting plate 50 is provided with two stabilizing blocks 54 at an end proximal to the hook portion 53, and the two stabilizing blocks 54 are spaced with each other. The hook portion 53 is located between the two stabilizing blocks 54. A reinforcing rib 55 for improving the structural strength is provided between each stabilizing block 54 and the bottom of the supporting plate 50.

When the hook portion 53 is locked in the positioning groove 14, the stabilizing blocks 54 tightly press the aerator mounting cover 101, so as to effectively suppress the water flow to drive a mounting ring of the aerator 80 to move in vertical direction when the water pressure of the faucet is unstable, thereby protecting the aerator 80.

The foregoing description illustrates and describes preferred embodiments of the present disclosure and is not intended to limit the present disclosure. There will be various modifications and changes to the present disclosure for those skilled in the art. Any modifications, equivalent substitutions, and improvements made without departing from the spirit and principle of the present disclosure should all be considered as falling within the scope of protection of the present disclosure.

What is claimed is:

1. A sensing and touch-controlled faucet, comprising a casing, wherein the casing comprises a water outlet arranged proximal to the bottom of a faucet working end, the casing further comprises a soap dispensing port and a mounting cavity communicating with the water outlet and the soap dispensing port, the soap dispensing port is arranged near the water outlet and the soap dispensing port is located at a side away from a faucet working end relative to the water outlet;

a covering plate, wherein the covering plate covers the casing for closing the mounting cavity;

a water flow sensor, wherein the water flow sensor is arranged on a side wall surface of the casing for controlling a water discharge of the water outlet;

a soap sensor, wherein the soap sensor is couple to the covering plate at an end proximal to the faucet working end for controlling a soap discharge of the soap dispensing port;

wherein, when a user's palm facing upward is placed below the water outlet, an inner side of the user's fingers is directly opposite to the soap dispensing port, the soap sensor is a pressure sensor, a water flow sensor trigger area and a soap sensor trigger area are located on different outer side surfaces of the casing and on outer side surfaces not containing the water outlet and the soap dispensing port.

2. The sensing and touch-controlled faucet according to claim 1, wherein the mounting cavity of the casing is internally mounted with a supporting plate, the soap sensor is mounted on the supporting plate and a lower end of the soap sensor contacts with a bottom part of the covering plate at an end proximal to the faucet working end;

the sensing and touch-controlled faucet further comprises a plurality of fasteners configured to engage the supporting plate into the mounting cavity, and when the supporting plate is engaged into the mounting cavity, an upper surface of the supporting plate is flat and smooth.

3. The sensing and touch-controlled faucet according to claim 2, wherein each fastener comprises a bolt and an engagement structure located at a top end of a nut portion of the bolt, a bottom wall of the mounting cavity protrudes upward to form a plurality of mounting columns having threaded holes, the bolts of the fasteners are connectable to the threaded holes of the mounting columns by threads, and the supporting plate is provided with through holes matching with the mounting columns, the bolts can pass through the through holes and the engagement structures are in interference fit with the through holes.

4. The sensing and touch-controlled faucet according to claim 3, wherein the engagement structure comprises an engagement ball, and the engagement ball has a hollow cavity.

5. The sensing and touch-controlled faucet according to claim 4, wherein the engagement structure further comprises a partition, the partition is arranged between two opposite cavity walls of the hollow cavity, and the partition splits the hollow cavity half and half to form two deformation cavities.

6. The sensing and touch-controlled faucet according to claim 2, wherein a bottom wall of the supporting plate proximal to the faucet working end is provided with a hook portion, a cavity wall of the mounting cavity facing the faucet working end is provided with a positioning groove for locking with the hook portion, when the hook portion is locked in the positioning groove, the supporting plate is positioned in a predetermined mounting position.

7. The sensing and touch-controlled faucet according to claim 2, wherein the sensing and touch-controlled faucet further comprises an aerator, a soap conveying pipe, and a connector for connecting the aerator and the soap conveying pipe; when the aerator is aligned with the water outlet, a soap outlet of the soap conveying pipe is aligned with the soap dispensing port.

8. The sensing and touch-controlled faucet according to claim 7, wherein the connector comprises an aerator mounting cover and a connecting rib, a first end of the connecting rib is fixedly connected to the aerator mounting cover, a second end of the connecting rib is fixedly connected to the soap conveying pipe, and the aerator is connected in the aerator mounting cover by threads.

9. The sensing and touch-controlled faucet according to claim 8, wherein a lower end of the supporting plate proximal to the hook portion is provided with a stabilizing block, when the supporting plate is located in a predetermined mounting position, the stabilizing block tightly presses the aerator mounting cover.

* * * * *